United States Patent [19]

Jarschke

[11] Patent Number: 4,739,720

[45] Date of Patent: Apr. 26, 1988

[54] KAYAK DECK PACK

[76] Inventor: Michael Jarschke, P.O. Box 1252, Crested Butte, Colo. 81224

[21] Appl. No.: 60,344

[22] Filed: Jun. 10, 1987

[51] Int. Cl.[4] ..... B63B 35/00

[52] U.S. Cl. ..... 114/347

[58] Field of Search ..... 114/347, 351, 353, 354, 114/361, 364

[56] References Cited

U.S. PATENT DOCUMENTS

| | | | |
|---|---|---|---|
| 1,172,974 | 2/1916 | Frayser | 114/364 |
| 3,958,289 | 5/1976 | Carison | 114/347 |
| 4,398,488 | 8/1983 | Mathieu | 114/343 |
| 4,593,642 | 6/1986 | Shay | 114/364 |

*Primary Examiner*—Joseph P. Peters, Jr.
*Assistant Examiner*—Jesûs Sotelo
*Attorney, Agent, or Firm*—Lee W. Tower

[57] ABSTRACT

A Kayak deck pack that sits attached to the Kayak deck directly in front of the paddler allowing the Kayaker easy access to items within the pack via a rear facing zipper.

13 Claims, 2 Drawing Sheets

KAYAK DECK PACK

BACKGROUND OF THE INVENTION

1. Field of the Invention

The present invention relates to a Kayak Deck Pack for a Kayak, and more particularly to a Kayak Deck Pack that sits attached to the kayak deck directly in front of the paddler allowing the kayaker easy access to items within the pack via a rear facing zipper.

2. Description of the Prior Art

Kayaks have long been a method of transportation and hunting and have recently become an important recreational activity. There is now a growing interest in ocean going kayaks, sea kayaks, whitewater kayaks and river touring kayaks. In all of these modern used of the kayak there are a number of items which the kayaker desires to take along with him in his kayak and the kayaker needs to securely store these items in a location with easy access. Generally a kayaker wears a lifevest, which by Coast Guard rules does not come equipped with pockets suitable for carrying various items; moreover, even if pockets were provided, they would not be suitable for bulky items. Also, the storage of bulky items on the kayaker's upper body would severely interfere with his handling and paddling of the kayak.

A kayaker wears a spray skirt, whose purpose is to keep water out of the inside of the kayak, around his waist. When the kayaker sits in the cockpit of the kayak he attaches the spray skirt around a coaming which surrounds the top of the cockpit, thus forming a water seal between his torso and the kayak deck. There is some room in the cockpit to store items; however, access to these items would require that the spray skirt be disconnected, which would result in water getting into the cockpit. Once this occurs the cockpit would require bailing and, in the meantime, the kayak would suffer a severe loss of maneuverability and could even capsize causing considerable danger to the kayaker. Storage of items in the cockpit also eliminates some free space in the cockpit and could cause entrapment of the kayaker, which could be fatal in the event of the kayak capsizing. Another problem with storing items in the spray skirt is that two hands are required to reposition the spray skirt on the coaming. The skirt must be hooked under the coaming in back of the kayaker, then stretched toward the front, using elbows to keep it from popping off as it is drawn tight. It usually needs to be seated in the coaming groove on the sides to ensure a proper seal. During this repositioning the paddle must be "parked" under deck rigging in front of the kayaker. The time spent with the paddle not in hand is especially dangerous for the kayaker, because during this time the paddle cannot be used for what is known as a "brace" stroke, which is the first line defense against capsizing.

The current way in which these difficulties are overcome is to store the items in waterproof bags which are stuffed under the deck rigging which is immediately in front of the kayaker. The "deck rigging" consists of criss crosses of elastic bungee cord that are attached to deck loops on the deck of the kayak. There are generally 6 deck loops on the front deck arranged in a rectangle with deck loops on each corner of the rectangle and deck loops half way along the length of the rectangle which is in the same direction as the length of the kayak. The method of securing items with the deck loops and the bungee cords is to attach a waterproof bag via a cord to a deck loop and then to tuck the waterproof bag under a criss cross of the bungee cord. Another purpose of the bungee cords is to enable the kayaker to tuck one tip of the kayak paddle under the bungee cord while he attends to some other matter.

There are a number of disadvantages associated with stuffing waterproof bags under bungee cords. The first problem is that the items under the bungee cords could slip around and extend into space required for paddling by the kayaker. Another disadvantage of stuffing itens under the bungee cords is that the irregularity of these items could impede the flow of air and water over the kayak deck making maneuverability of the kayak more difficult. Finally the items under the bungee cords could impede the kayaker from temporarily stowing a paddle under one set of the deck rigging. Generally the kayaker would use the forward set of deck rigging to hold the paddle and, while putting the paddle under the forward deck rigging, the items stored under the rear set of bungee cord deck rigging could be disloged by the paddle.

There is a need for a kayak deck pack which solves the foregoing problems. Examples of several types of storage compartments for canoes are in U.S. Pat. Nos. 1,172,974, 3,958,289, 4,398,488, and 4,593,642. Both canoes and kayaks have a common drawback in that they are small boats with little storage area. From the references for storage compartments in canoes, it is clear that a kayak deck pack is desirable and necessary. Accordingly, improvements in kayak deck packs will be very valuable and desirable in the recreation field of kayaking. Also it would be valuable and desirable to have a kayak deck pack that has features that make it easier and safer to access than the current methods described above.

SUMMARY OF THE INVENTION

With the above background in mind, it is among the primary objectives of the present invention to provide an improved kayak deck pack that will provide the kayaker with easy access to items stored within the deck pack. It is another object of the present invention to provide a kayak deck pack that will store items and maintain proper air and water flow over the kayak. This is accomplished by designing the bag with a shape that has a low cross section to water coming over the bow of the kayak, thereby reducing any drag caused by the kayak deck pack. This is further accomplished by allowing water to flow in and out of the deck pack. Items required to be kept waterproof are stored inside of waterproof bags and are tethered to a plastic D ring in the center of the inside of the kayak deck pack.

It is a further object of the present invention to provide a tether loop on top of the kayak deck pack that can be used to hold the kayak bowline in easy reach of the kayaker. In the current state of the art the bowling is tucked under the bungee cord deck rigging and can become dislodged by the shifting of items tucked under the bungee cord deck rigging.

It is another object of the present invention to provide pleats in the center and possible on the sides of the kayak deck pack to provide increased volume to store items in the bag; however, to reduce drag to air and waves, no pleats are put in the front or forward edge of the kayak bag as it sits on the kayak deck. The sides of the kayak bag are designed so that there is plenty of excess material at the rear of the kayak bag to provide volume for storage. The sides are then tapered down to virtually no excess material at the very front edge of the side, to reduce any drag to air and water. If pleats are provided on the sides of the kayak bag, these are also tapered in the same manner.

It is another object of the present invention to design the kayak deck pack out of material such as heavy duty "Cordura" material and heavy duty zippers. It is a further object of the present invention to design the kayak deck pack so that the length of a side is generally the same as the length between two deck loops mounted on the front deck of the kayak. The width of the kayak deck pack is also designed to be approximately the same as the distance from a port deck loop to a starboard deck loop. Laces are provided at the front two edges of the kayak deck pack for tying to a set of deck loops. The rear of the bag is connected to another pair of kayak deck loops via straps that are fastened by camlock buckles. Straps and camlock buckles can also be used to secure the front of the kayak bag to the deck loops instead of the laces. Securing the kayak deck pack to the kayak via these four deck loops ensures that expensive items stored within the kayak deck pack will not be lost. The items that could be stored within the kayak deck pack include: sunglasses, gloves, sunscreen, lip balm, a watch, a compass, camera, flashlight, pocket knife, maps, tide logs, car keys, a whistle for fog safety, firearm, fishing tackle, tidepool specimens and small spares of assorted kayak related hardware such as clips, rings, screws, etc. Of course, what is stored in the kayak deck pack will be a function of the needs and desires of the individual kayakers.

The features of the present invention which are believed to be novel are set forth with particularity in the appended claims.

Other objects and many of the attendant features of this invention will be more readily appreciated as the same becomes better understood by reference to the following detailed description and considered in connection with the accompanying drawings in which like reference symbols designate like parts throughout the figures.

DESCRIPTION OF THE PREFERRED EMBODIMENT

Figure 1:
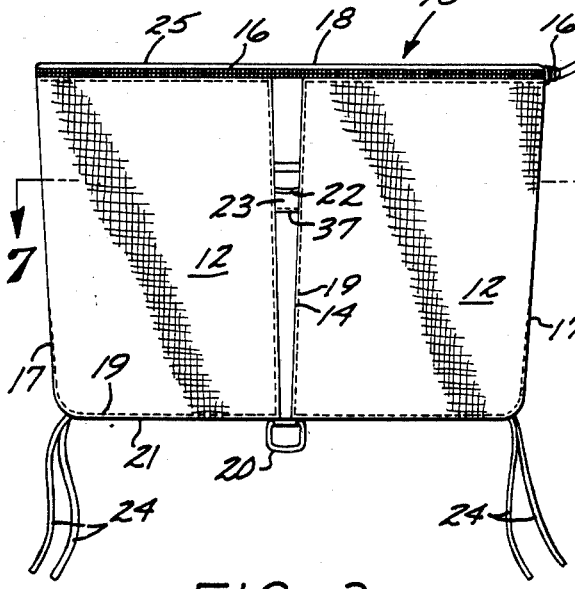
FIG. 1 is a top view of a kayak deck pack, which is constructed in accordance with the principles of the present invention.
Figure 2:
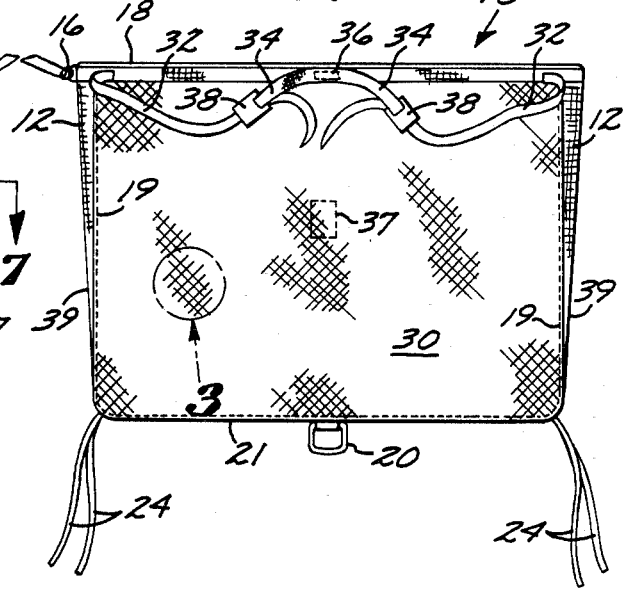
FIG. 2 is a bottom view of a kayak deck pack, which is constructed in accordance with the principles of the present invention.

The present invention is a kayak deck pack 10, as shown in FIG. 1 and FIG. 2, having a top panel 12, a rear panel 18, and a bottom panel 30. The top panel 12 has a top expansion pleat 14, which provides a means for expanding the volume of the kayak deck pack. The rear panel 18 is actually an extension of the same material that comprises the bottom panel 30 and only one pattern is used to cut the material that then contains both the rear and bottom panels. This pattern has an area having the shape of a slight trapezoid, which is the area of the bottom panel 30 with the front edge 21 of said bottom panel of shorter length than the rear edge of said bottom panel 25, and an area having the shape of a half oblong attached to the trapezoid base with the half oblong having the same length as the base of the trapezoid, which is the area of the rear panel 18. The rear panel 18 is attached to top panel 12 by a rear panel zipper 16, which provides a means for securing the rear panel to the top panel. The top panel 12 and the rear panel 18 are attached to one another along the kayak deck pack sides 17 and the front edge of the kayak deck pack 21 via stitching 19. A front D ring 20, which provides a means for attachment of items to the kayak deck pack and/or as a means for a safety lash between the kayak deck pack and the kayak, is attached to the front edge of the kayak deck pack 21. Top D ring 22 is attached to the top panel within the top expansion pleat 14 by top D-ring tab 23, which is stitched to the top panel by stitching 37. Top D ring 22 provides another means for attachment of items to the kayak deck pack. Laces 24 are attached to the front corners of the front edge 21 of the kayak deck pack for the purpose of providing a means of securing the kayak deck pack to the kayak.

Referring to FIG. 2, rear straps 32 are attached to the rear corners of the bottom panel and straps 34 with sewn on camlocks 38 are attached to the bottom panel 30 via center rear strap stitching 36. Straps 32 are attached to straps 34 via the camlocks 38. These straps and camlocks provide another means for securing the kayak deck pack to the kayak. As shown in FIG. 2, the top panel 12 is tapered along the taper line 39 so that there is excess top panel material at the rear of the kayak deck pack to provide ample room for storage and access to the interior to the kayak deck pack through rear panel 18. Conversely, as the top panel approaches the front edge 21 of the kayak deck pack the top panel 12 is tapered so that there is no excess top panel material at the front of the kayak deck pack. This provides a means for smoothing the air and water flow over the front of the kayak deck pack.

Figure 3:
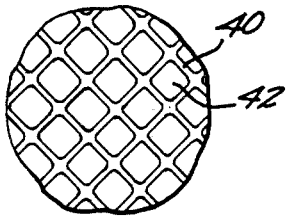
FIG. 3 is a section of FIG. 2 showing the netting on the bottom panel of the kayak deck pack.

FIG. 3 is a detail of a section of the bottom netting 40 of the bottom panel 30 of the kayak deck pack 10. The spaces or holes 42 between the netting provide a means for draining any water that may enter the inside of the kayak deck pack.

Figure 4:
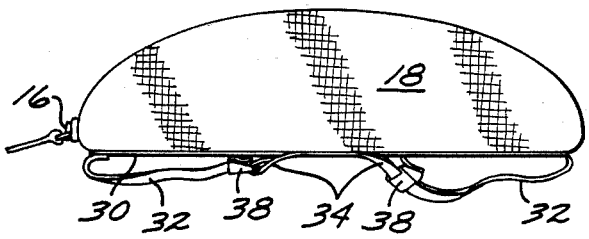
FIG. 4 is a rear panel view of the kayak deck pack.

FIG. 4 is a view of the rear panel 18 of the kayak deck pack showing the rear straps 32 and 34 and camlocks 38 in more detail. As shown in FIG. 4 rear panel 18 has an approximate half oblong shape. The top panel 12 and the rear panel 18 are both constructed of material such as heavy duty "Cordura". It is also possible to construct the entire kayak deck pack out of netting material; however, using a heavy duty material such as "Cordura" for at least the top panel provides a smoother water flow over the kayak deck pack.

Figure 5:
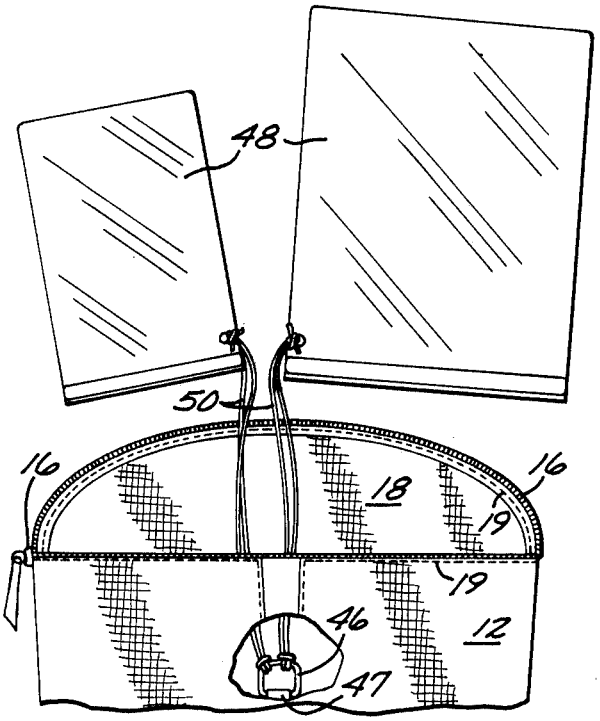
FIG. 5 is a top view of the kayak deck pack with the rear panel unzipped and folded down showing waterproof bags tethered to the inside of the kayak deck pack via a D-ring.

FIG. 5 is a top view of a kayak deck pack with the rear panel 18 unzipped and folded down showing waterproof bags 48 tethered to the kayak deck pack via tether cords 50 attached to inside D ring 46, which provides a means for tethering items meant to be stored within the kayak deck pack to the kayak deck pack itself. Also shown is stitching 19 which attaches zipper 16 to the rear edge of the top panel 12 and the top edge of the rear panel 18. The inside D ring 46 is attached to the kayak deck pack by inside D ring tab 47, which is stitched to the top and bottom panels by stitching 37 shown in FIG. 6.

Figure 6:
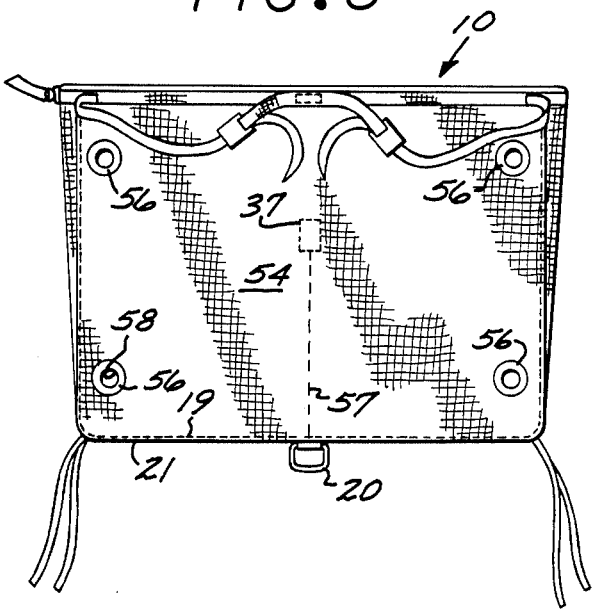
FIG. 6 is a bottom view of an alternate design that has grommets mounted onto the bottom panel for drainage instead of having a bottom panel made of netting.

FIG. 6 shows a design in which an alternate bottom panel 54 is made of the same material as the top panel 12 and the rear panel 18, such as heavy duty "Cordura" material. To provide a means for drainage for water which may enter the kayak deck pack, drainage grommets are attached to the four corners of the bottom panel 54. Every drainage grommet 56 has a drainage hole 58 in its center. Also shown in FIG. 6 is optional left/right compartment stitching 57, which stitches the top and bottom panels together and provides a means for dividing the kayak deck pack into left and right storage compartments.

Figure 7:
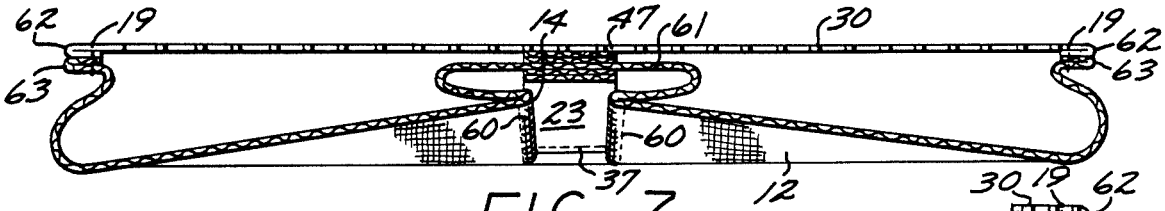
FIG. 7 is a section of FIG. 1 showing the top expansion pleat of the kayak deck pack and the seams between the top and bottom panels.

FIG. 7 is a section of FIG. 1 showing the details of top expansion pleat 14 and how the top panel 12 and the bottom panel 30 are stitched together. The top expansion pleat 14 allows sufficient room between the top panel 12 and bottom panel 30 to store items. The top expansion pleat is defined by pleat stitching 60. The center of the pleat 61, which is a portion of top panel 12, is attached to the bottom panel 30 by stitching 37, which also attaches the top D ring tab 23, and the inside D ring tab 47 to the bottom panel. The top panel 12 and bottom panel 30 are also joined by stitching 19 along bottom panel edge fold 62 and top panel edge fold 63.

Figure 14:
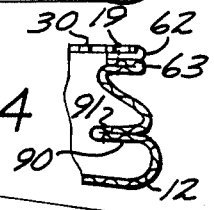
FIG. 14 is a drawing showing an alternate design with side expansion pleats.

FIG. 14 shows an alternate design with side pleats 90 formed along the sides of the top panel by stitching 91. The purpose of such side pleats would be to provide another means for expanding the volume within the kayak deck pack. These side pleats are tapered so that a large pleat is at the rear of the kayak deck pack while the pleat virtually tapers to nothing at the front of the kayak deck pack.

Figure 8:
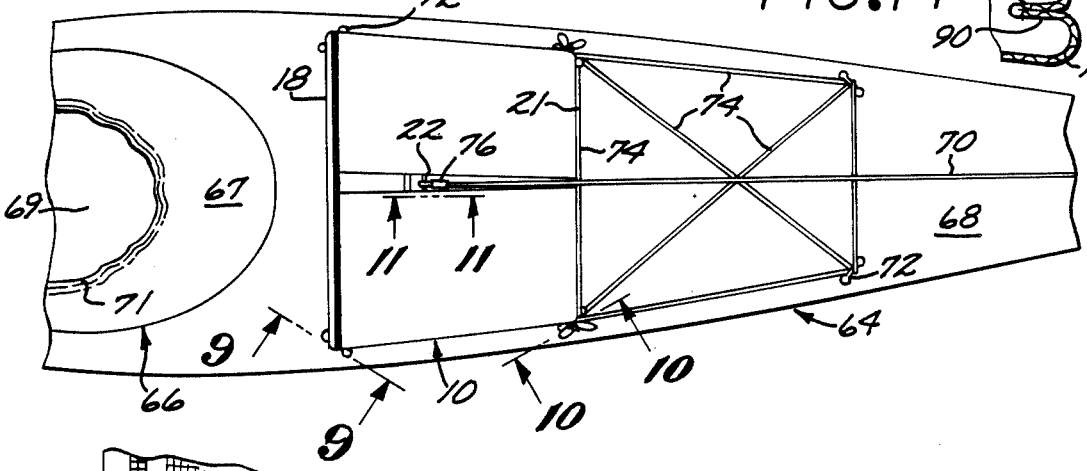
FIG. 8 is a view of a kayak deck pack mounted on the kayak.

FIG. 8 shows the front deck of a kayak 64. As shown, the kayak cockpit 66 is just to the rear of where the kayak deck pack 10 is mounted to the kayak deck 68. A kayaker's torso 69 is positioned in the center of the kayak cockpit 66. To prevent water from entering the kayak cockpit, the kayaker wears a spray skirt 67 with a built in elastic waist 71 around his torso. The spray skirt is then placed around a coaming surrounding the cockpit. On the front deck 68 of the kayak there are a number of deck loops 72. The kayak deck pack 10 is attached to four of these deck loops. The dimensions of the kayak deck pack are such that the length along each side of the kayak deck pack generally matches the distance between the corresponding deck loops. Due to the tapered kayak bow, the shape of the bottom panel 30 is slightly trapezoidal.

Figure 11:
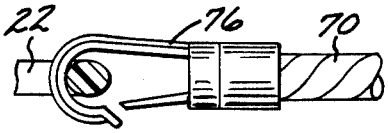
FIG. 11 is a section of FIG. 8 showing a kayak bowline snap hook fastened to a D-ring on the kayak deck pack.
Figure 12:
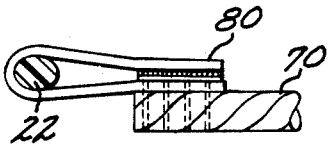
FIG. 12 is an alternate design showing a kayak bowline fastened via a velcro fastener to a D-ring on the kayak deck pack.

In front of the kayak deck pack, elastic bungee cords 74 are criss crossed between deck loops 72, which provide means on the deck for attachment of the kayak deck pack. As shown, typically one pair of deck loops 72 are used both for mounting the deck pack 10 and for attaching the elastic bungee cords 74. As shown in FIG. 8, the kayak deck pack 10 is directly accessible to the kayaker at position 69 via the rear panel 18. This allows the kayaker to store a multitude of items within the kayak deck pack and to access these items as required. As illustrated in FIG. 5 if these items need to be kept waterproof then they can be stored within waterproof bags 48 and tethered to the kayak deck pack via inside D ring 46 to prevent loss. Top D ring 22 can be used to tether the kayak bowline 70 via bowline snap hook 76. FIG. 11 shows a section of FIG. 8 showing kayak bowline snap hook 76 attached to front D ring 22. FIG. 12 shows an alternate arrangement which provides a velcro bowline fastener 80 to attach kayak bowline 70 to top D ring 22. Either design ensures that the bowline will be within easy access of the kayaker at position 69. The purpose of the elastic bungee cords 74 criss crossed between deck loops 72 is to provide a place to stow the kayak paddle when not in use.

Figure 9:
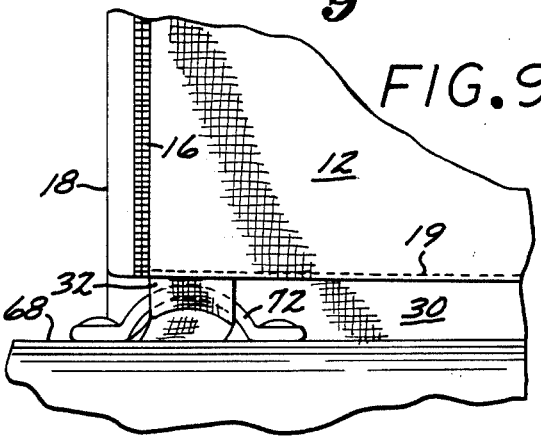
FIG. 9 is a section of FIG. 8 showing a rear strap of the kayak deck pack fastened to a deck loop and showing the height of the rear panel.
Figure 10:
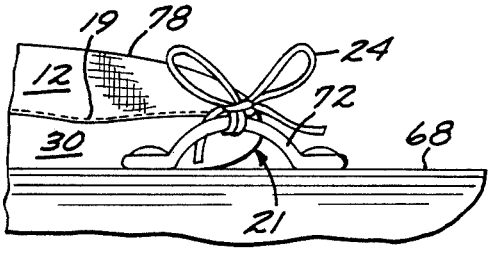
FIG. 10 is a section of FIG. 8 showing a front lace of the kayak deck pack fastened to a deck loop and showing the shape of the kayak deck pack as it tapers toward its front edge for minimal drag.

FIG. 9 is a section of FIG. 8 showing how rear strap 32 is attached to deck loops 72. FIG. 10 is a section of FIG. 8 showing how laces 24 are attached to deck loops 72. Also shown on FIG. 10 is the tapered front 78 of the top panel, which provides a means for a smooth air and water flow over the kayak deck pack.

Figure 13:
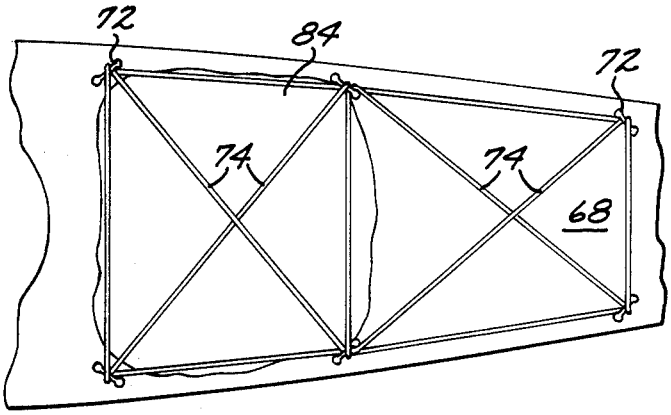
FIG. 13 PRIOR ART
FIG. 13 is a drawing showing the prior art method of carrying articles on the kayak by strapping then under bungee cords criss crossed between the deck loops on the kayak deck.

FIG. 13 illustrates the prior art method of carrying items on the deck of a kayak. In the prior art, elastic bungee cords were criss crossed between all of the deck loops 72. Then various items 84 were merely stuffed under these elastic bungee cords. As discussed above the disadvantages of the prior art include: the possibility of loss of items due to the insecure method of attaching the items to the kayak, the interference with the wind and the water flowing over the kayak due to the non-aerodynamic shape of the various items, and the possible interference with the kayaker if items under the elastic bungee cords slipped around and extended into space required for paddling by the kayaker. The alternate place to store items was in the cockpit but access to these items required that the spray skirt be disconnected which could result in water getting into the cockpit. In this event the kayaker would have to bail the cockpit and this activity plus the loss of maneuverability due to the extra water in the kayak could cause the kayak to capsize causing considerable danger to the kayaker. Also the storage of items in the cockpit would eliminate some free space in the cockpit and could cause entrapment of the kayaker which could be fatal in the event of capsizing.

Although the foregoing has been a description and illustration of specific embodiments of the invention, various modifications and changes thereto can be made by persons skilled in the art without departing from the scope and spirit of the invention as defined by the following claims.

What is claimed is:

1. A kayak deck pack for stowing various items on a tapered front deck of a kayak, comprising:

a bottom panel having a front, rear and side edges and a trapezoidal shape such that said rear edge of said bottom panel has slightly more length than said front edge of said bottom panel to match said tapered front deck of said kayak;

a rear panel continuous with said rear edge of said rear panel and having a half oblong shape such that one edge of said half oblong shape is a straight line and has a length that matches said length of said rear edge of said bottom panel;

a top panel having front, rear and side edges attached along said front and side edges to said front and side edges of said bottom panel;

means, attached to said rear edge of said front panel and said rear panel, for detachably securing said rear edge of said top panel to said rear panel;

means, attached to said bottom panel, for draining water from inside said kayak deck pack; and means, mounted to said kayak deck pack, for attaching said kayak deck pack to said kayak deck.

2. The kayak deck pack of claim 1, wherein said top panel tapers toward said front edge of said top panel so that at said rear edge of said top panel, said bottom panel and said top panel are separated by the height of said rear panel and so that at said front edge of said top panel, said bottom panel and said top panel are directly attached to one another.

3. The kayak deck pack of claim 2, wherein said top panel further comprises:

a top expansion pleat built into said top panel for the purpose of expanding the inside volume of said kayak deck pack.

4. The kayak deck pack of claim 3, further comprising:

means, mounted inside said kayak deck pack, for tethering said various items to said kayak deck pack.

5. The kayak deck pack of claim 4, further comprising:

means, mounted on top panel, for securing items to the kayak deck pack.

6. The kayak deck pack of claim 5, further comprising:

a first side expansion pleat built into said top panel for the purpose of expanding the inside volume of said kayak deck pack; and a second side expansion pleat built into said top panel for the purpose of expanding the inside volume of said kayak deck pack.

7. A kayak deck pack for stowing various items on a tapered front deck of a kayak, comprising:

a bottom panel having a front, rear and side edges and a trapezoidal shape such that said rear edge of said bottom panel has slightly more length than said front edge of said bottom panel to match said tapered front deck of said kayak;

a rear panel continuous with said rear edge of said rear panel and having a half oblong shape such that one edge of said half oblong shape is a straight line and has a length that matches said length of said rear edge of said bottom panel;

a top panel having front, rear and side edges attached along said front and side edges to said front and side edges of said bottom panel and wherein said top panel tapers toward said front edge of said top panel so that at said rear edge of said top panel, said bottom panel and said top panel are separated by the height of said rear panel and so that at said front edge of said top panel, said bottom panel and said top panel are directly attached to one another.

means, attached to said rear edge of said front panel and said rear panel, for detachably securing said rear edge of said top panel to said rear panel;

means, attached to said bottom panel, for draining water from inside said kayak deck pack;

means, mounted to said kayak deck pack, for attaching said kayak deck pack to said kayak deck;

means, mounted inside said kayak deck pack, for tethering said various items to said kayak deck pack; and means, mounted on top panel, for securing items to said kayak deck pack.

8. The kayak deck pack of claim 7, wherein said means for detachably securing said top panel to said rear panel comprises a zipper.

9. The kayak deck pack of claim 8, wherein said means for draining water from inside said kayak deck pack comprises netting used for said bottom panel.

10. The kayak deck pack of claim 8, wherein said means for draining water from inside said kayak deck pack comprises drainage grommets having holes attached to said bottom panel.

11. The kayak deck pack of claim 9 or 10, wherein said means for tethering various items to said kayak deck pack comprises a D-ring attached within said kayak deck pack to said bottom panel and said means for securing items to said kayak deck pack comprises a D ring attached to said top panel.

12. The kayak deck pack of claim 11, further comprising:

a top expansion pleat built into said top panel for the purpose of expanding the inside volume of said kayak deck pack.

13. The kayak deck pack of claim 12, further comprising:

a first side expansion pleat built into said top panel for the purpose of expanding the inside volume of said kayak deck pack; and a second side expansion pleat built into said top panel for the purpose of expanding the inside volume of said kayak deck pack.

* * * * *